US006341449B1

(12) United States Patent
Stahl

(10) Patent No.: US 6,341,449 B1
(45) Date of Patent: Jan. 29, 2002

(54) SNAP-FIT CUSTOM WEATHERSTRIPPING AND PARTING STOP

(76) Inventor: John H. Stahl, 301 Morriss-Essex Turnpike, Summit, NJ (US) 07901

( * ) Notice: Subject to any disclaimer, the term of this patent is extended or adjusted under 35 U.S.C. 154(b) by 0 days.

(21) Appl. No.: 09/594,351

(22) Filed: Jun. 14, 2000

(51) Int. Cl.[7] ..... E05D 13/00
(52) U.S. Cl. ..... 49/458
(58) Field of Search ..... 49/475.1, 489.1, 49/482.1, 163, 458

(56) References Cited

U.S. PATENT DOCUMENTS 88,640 A * 4/1869 Johnston ..... 49/458
4,604,831 A * 8/1986 Tunnicliffe et al. .... 49/489.1 X
5,560,154 A * 10/1996 Matarazzo ..... 49/489.1 X

* cited by examiner

*Primary Examiner*—Jerry Redman
(74) *Attorney, Agent, or Firm*—Donald W. Meeker

(57) ABSTRACT

A replacement parting stop installed in a double-hung window frame has a top groove on one side and a bottom groove on the other side. The grooves are equal in length to the top sash and bottom sash respectively. A pile weatherstrip has a base with protruding resilient ridges on each side along its length. The pile weatherstrip, cut into lengths equal to the top groove and bottom groove, is pressed into the grooves compressing the ridges with an airtight friction fit with the parting stop installed in place on the window frame. The weatherstrip is easily pulled out of the grooves and replaced as necessary with weatherstrip of a desired pile height to fill the gap between the parting stop and the sash. The ridges are formed in a barb-like shape in cross-section so that the weatherstrip is easily insertable in the grooves without the need for tools by aligning the weatherstrip along the length of the respective groove and pressing the weatherstrip directly into the groove along the length of the groove with the parting stop in place in the window frame. The weatherstrip is removed by pulling it directly out of the groove along the length of the groove without removing the parting stop from the window frame. The resilient barbs permit easy removal. The pile may have an additional air impermeable strip of flexible material adjacent to the pile.

20 Claims, 2 Drawing Sheets

SNAP-FIT CUSTOM WEATHERSTRIPPING AND PARTING STOP

BACKGROUND OF THE INVENTION

1. Field of the Invention

The present invention relates to weatherstripping for windows and in particular to a snap-fit weatherstripping for parting stops which is easy to install and remove so that the window may be custom fit with the required depth of insulation.

2. Description of the Prior Art

When installing new window sashes in old frames, the sash often fits loosely, allowing air to pass around the sash where the sash meets the parting stop, the vertical protruding element on each side of the window frame forming the center separation between the two tracks of the two vertical sliding sashes. Replacement of the pile weatherstripping on the parting stop with a deeper pile is often required to prevent the air flow around the sashes. With most pile weatherstripping, the window frame must be disassembled and the entire sash assembly must be removed including the inside stop molding. The lower sash and parting stop must be removed. Then the old T-shaped weatherstripping must be removed from the U-shaped slot by sliding the weatherstripping out of the slot from the bottom or top of the parting stop. Since there is one pile weatherstrip on each side of the parting stop, running the length of the parting stop, sliding the two weatherstrips out of the parting stop may take considerable time and effort. The new T-shaped nylon weatherstripping would then be installed by sliding it into the slot. This sliding installation the length of the parting stop may also be a tedious operation. The entire process of disassembly, removal, insertion, and reassembly costs time and money.

Another problem with the prior art is that the weatherstrip runs the length of the parting stop on both sides of the parting stop, so that both sashes are always in full contact with the weatherstrip whether the sashes are open or closed. Naturally in the closed position contact of the sash with the weatherstrip is desirable to keep the air from passing around the sash. However, when opening the sash contact with the weatherstrip interferes with the sliding, making the sash difficult to move and causing possible damage to the weatherstrip. With the window sash in the open position allowing the air to pour into the room, there is no point in trying to prevent the air from passing around the edges of the sash. Furthermore, having the weatherstrip exposed for half its length with the window closed is unsightly, detracting from the appearance of the house and exposing the weatherstrip to the elements and causing fast deterioration of the weatherstrip due to sun and moisture and temperature extremes.

Prior art U.S. Pat. No. 4,604,831, issued Aug. 12, 1986 to Tunmicliffe et al., claims sliding sash windows with T-shaped pile weatherstripping held in plastic U-shaped slots running along the length of each side of the parting stop (called parting bead 14 and 20 in the patent) shown in FIGS. 2, 3, 7, and 8. The weatherstripping must slide into and out of the slot with the inherent difficulties of having to disassemble the window frame and remove the parting stop in order to change the weatherstrip costing much time and energy and frustration with the tight friction fit in the long slot. The rigid barbed pile carrier 27 of FIGS. 4, 5C, and 6 requires that the pile carrier be installed in the T-shaped groove of the window frame and the pile weatherstrip 34 and 48 be inserted into and removed from the pile carrier by sliding the pile weatherstrip the length of the slot in the pile carrier, similar to the tedious process of FIGS. 2 and 3.

Prior art U.S. Pat. No. 3,224,047, issued Dec. 21, 1965 to Horton, indicates a T-shaped insertable pile weatherstripping having a metal hooked edge along the bottom with pointed protrusions formed in the edge for engaging the side of the groove in which it is inserted. The metal points 22 of the insertable portion would make the weatherstrip difficult to remove as the points would bite into the side of the slot.

U.S. Pat. No. 4,510,715, issued Apr. 16, 1985 to Giguere, describes a square-cornered Y-shaped composite weather strip for windows and doors having a stiff T-shaped base with rigid ribs on the long insertion portion for a tight friction fit in a slot of the frame or sash,. and two spaced apart flexible wings protruding away from the base rather than nylon pile. The wings contact the opposing surface and trap air between the wings for insulation. The wings would seem to cause too much friction to inhibit the movement of the window sash and the rubberized material would deteriorate quickly due to exposure to the weather. The hard ribs on the insertion portion would require hammering or other strong force to insert the weatherstrip and it would be difficult to remove.

SUMMARY OF THE INVENTION

A primary object of the present invention is to provide a custom fit changeable pile weatherstrip for windows which is replaceable in different heights of pile to accommodate variations in air space due to aging of the frame and sash and also to provide the proper air seal for replacement window sashes which may vary slightly from the width of the sashes being removed.

Another object of the present invention is to provide a window weatherstrip which is easy to insert and easy to remove with the window frame fully intact, not requiring disassembly of the window frame, so that the weatherstrip is easily replaced when it becomes worn with use or damaged by overpainting, or as changes occur in the fit of the sashes in the window frame due to shrinkage or expansion of the wood or wear.

An additional object of the present invention is to provide a weatherstrip on a parting stop with the weatherstrip positioned only on each side of the parting strip adjacent to the closed window sash, leaving the parting stop without weatherstrip on the portion adjacent to the open window sash for most efficient operation in sliding the sashes and providing longer life for the weatherstrip which is concealed by the closed sash thereby also rendering the window more attractive without being able to see the weatherstrip with the sashes in the closed positions, especially important in restorations, and requiring only half the material to cut the cost in half.

One more object of the present invention is to provide a weatherstrip with a soft barbed insertion portion for ease of installation with a compression fit and ease of removal by pulling on the weatherstrip to release the compression, and providing a tighter fit due to the insertion portion conforming to the shape of the groove in which it is inserted, thereby providing a better air barrier.

An added object of the present invention is to provide a replacement parting stop for sliding sash windows fabricated preferably of a synthetic molded or extruded material with a groove near the outside edge of the parting stop running halfway down the parting stop on one side equal to the height of one sash and running halfway down the parting stop on an alternate end of the parting stop on the other side of the parting stop, equal to the height of the other sash. The grooves are shaped to receive the flexible barbed insertion portion of the weatherstrip with an air-tight compression fit and the synthetic material has a texture conducive to creating a friction bond with the insertion portion to prevent slippage of the weatherstrip in the groove.

In brief, a parting stop, preferably of synthetic molded or extruded material, is provided with alternating longitudinal grooves on each side the length of the window sash on that respective side. The old parting stop is removed and the new one installed by conventional means. Any of a variety of pile weatherstrips having different heights of pile and a pliable barbed insertion portion is pressed into the groove with an airtight compression fit on each side the height of the sash on that respective side. Thereafter the pile weatherstrip may be easily removed by pulling it out of the grooves with the parting stop in place in the window frame and easily replaced by pressing a new length of weatherstrip of the desired pile height into the grooves. The same pile weatherstrip could be used to restrict airflow at other locations around the window.

An advantage of the present invention is that the weatherstrip could, if desired, be easily removed and inserted without the use of tools.

Another advantage of the present invention is that the pile weatherstrip could be easily exchanged for another of a different pile height for a custom fit or different weatherstrip type as desired.

An additional advantage of the present invention is that having no exposed pile with the sashes closed creates an attractive appearance, especially important in restoration work.

One more advantage of the present invention is that it requires only half of the length of pile weatherstrip normally used on parting stops, thereby saving considerably in costs of material and labor.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
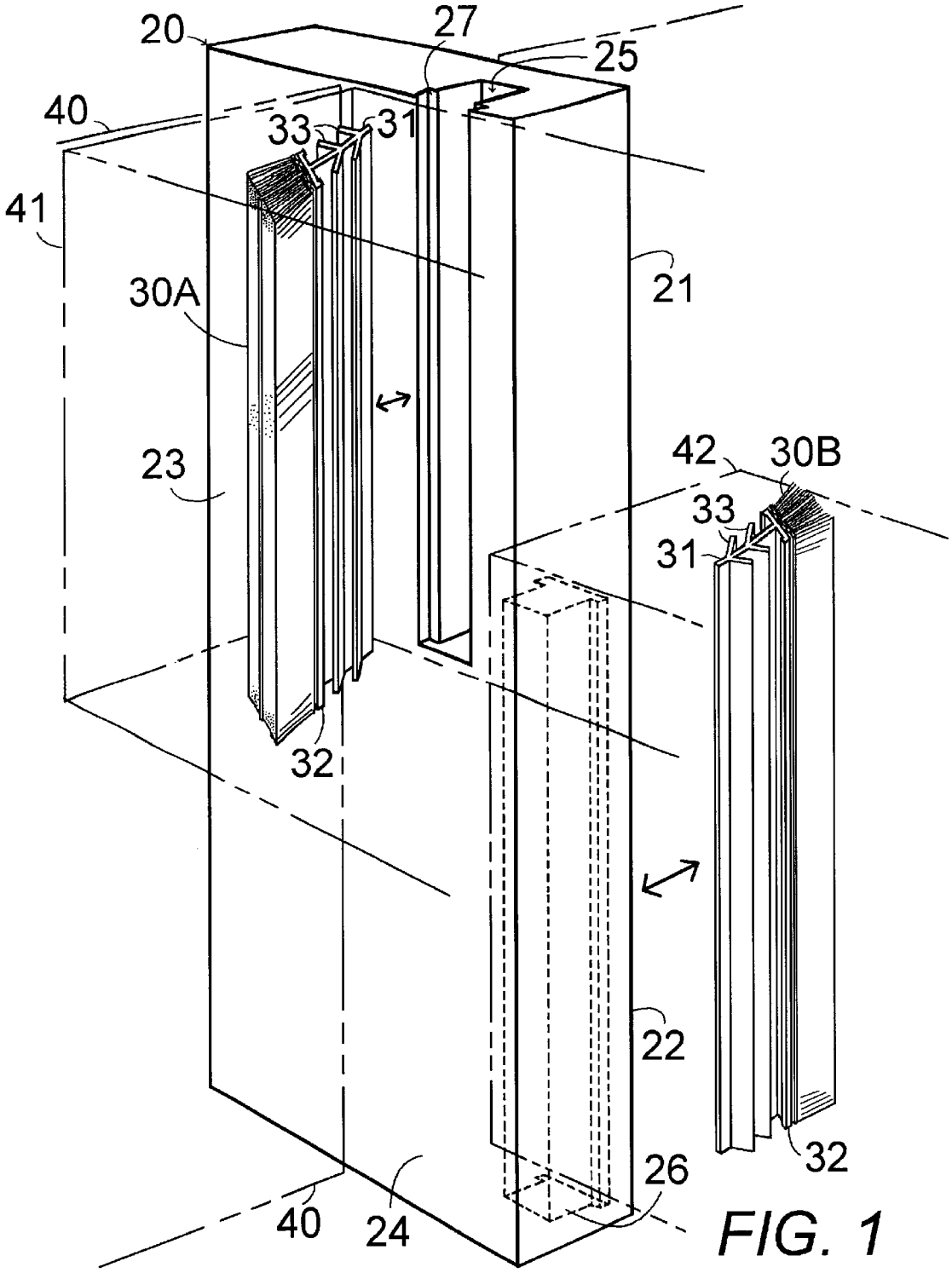
FIG. 1 is a schematic partial perspective view showing the parting stop of the invention (substantially reduced in length) installed on the window frame with the two weather strips aligned for insertion in the vertical grooves of the parting stop.

In FIGS. 1–15, a snap-in compression-fit custom weatherstrip system for a double hung window having a vertical parting stop dividing the running tracks of an upper window sash and a lower window sash, comprises an improved parting stop 20 with a top weatherstrip 30A removably insertable in an upper groove 25 on one side 23 of the parting stop 20 adjacent to the upper window sash 41 and a bottom weatherstrip 30B removably insertable in a lower groove 26 on the other side 22 of the parting stop 20 adjacent to the lower window sash 42.

Figure 4:
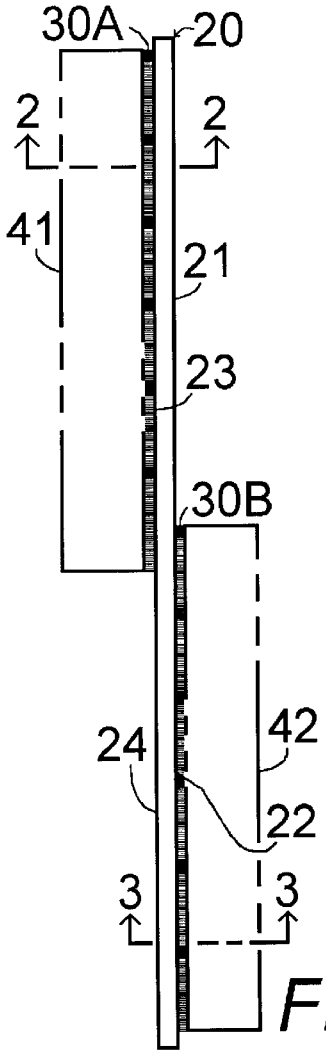
FIG. 4 is an elevational view showing the parting stop with the upper weatherstrip installed in the parting stop for the full length of the upper window sash and the lower weatherstrip installed in the parting stop for the full length of the lower window sash.

As best seen in FIGS. 1 and 4, the improved parting stop 20 is installed by conventional means, such as nails, screws, adhesive, or a friction fit, vertically in the double hung window frame 40 to replace the conventional parting stop between the running tracks of the window sashes. As seen in FIG. 1, he improved parting stop 20 has a top vertical groove 25 on one upper side 23 of the improved parting stop 20 from a top end of the improved parting stop along a portion of the improved parting stop equal to the height of the top sash 41 and a bottom vertical groove 26 on the other bottom side 22 of the improved parting stop from the bottom of the improved parting stop upwardly to a distance equal to the height of the bottom sash 42.

The opposite top side 21 of the parting stop 20 and the opposite bottom side 24 of the parting stop 20 are smooth with no grooves and no weatherstrip so that the sashes may slide easily when opening and closed and to require only half the length of weatherstrip normally used. The weatherstrips 30A and 30B are shielded by the window sashes 41 and 42 in the closed position to prevent the deterioration of the weatherstrips, as seen in FIG. 4, and the pile 35 and nylon barrier 34 of the weatherstrip, as seen in FIG. 5, prevents airflow between the window sashes 41 and 42 and the parting stop 20 for the full length of the window sashes.

Figure 2:
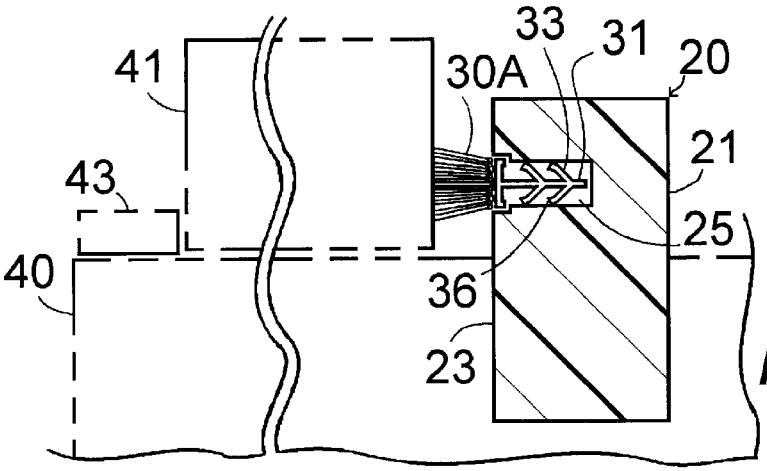
FIG. 2 is a partial cross-sectional view taken through 2—2 of FIG. 4 showing the upper portion of the parting stop installed in the window frame with the upper weatherstrip contacting the upper window sash.
Figure 3:
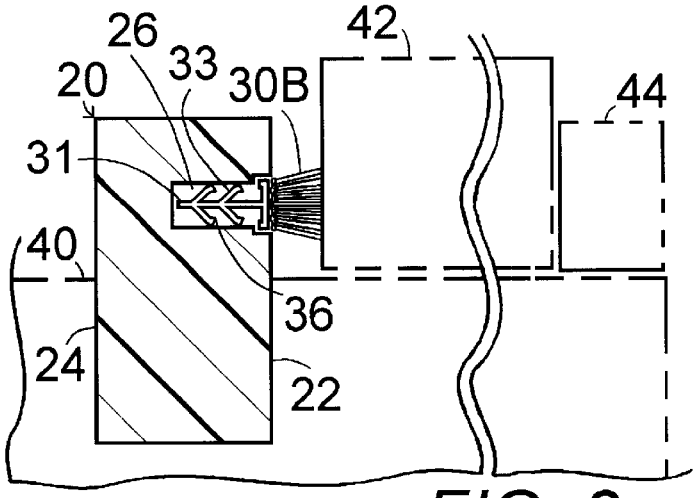
FIG. 3 is a partial cross-sectional view taken through 3—3 of FIG. 4 showing the lower portion of the parting stop installed in the window frame with the lower weatherstrip contacting the lower window sash.
Figure 5:
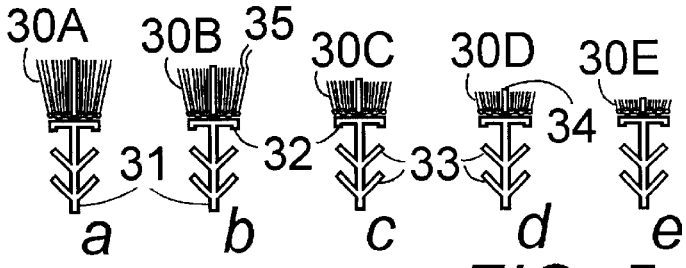
FIGS. 5*a*–*e* are end views of various embodiments of the weatherstrip having varying lengths of pile.

In FIGS. 1 and 5, elongated weatherstrips 30A-E each have a base comprising an extruded strip of synthetic material, T-shaped in cross-section, with a central vertical support 31 and having at least one resilient ridge 33, preferably two ridges 33, protruding from each side along the length of the weatherstrip. An airtight material, preferably a nylon pile 35, is permanently attached to a flat top 32 of the T-shaped cross-sectioned base by adhesive or heat staking or other conventional means. The grooves 25 and 26 in the parting stop 20 are T-shaped in cross-section to accommodate the weatherstrip removably snapped into the grooves with a friction compression fit therein with only the pile 35 protruding. The grooves 25 and 26 are slightly narrower than the base of the weatherstrip so that the tips 36 of the resilient ridges 33 bend in compression for an airtight compressed friction fit, as seen in FIGS. 2 and 3 to retain the weatherstrip in the grooves. The snap-in compression-fit installation of the weatherstrip 30 in the grooves 25 and 26 may be performed with the parting stop 20 installed in the window frame 40. The weatherstrip 30 may be removed by pulling the weatherstrip 30 out of the grooves with the parting stop 20 in place on the window frame 40.

The airtight pile 35 material may further comprise a resilient air-impermeable strip 34, such as a thin sheet of airtight synthetic material, adjacent to the pile running the length of the weatherstrip, which may be centrally positioned in the pile 35, as seen in FIG. 5.

The pile 35 and the resilient strip 34 are capable of being compressed to fit between the improved parting stop 20 and the window sashes, as seen in FIGS. 2, 3, and 4. The weatherstrip 30 is capable of being cut into a length equal to the top vertical groove 25 and a length equal to the bottom vertical groove 26, the two lengths of weatherstrip capable of being pressed into the grooves for installation of the weatherstrip and pulled out of the grooves for removal with the improved parting stop 20 installed in the window frame.

The weatherstrip 30 forms an airtight barrier capable of preventing air from passing between the improved parting stop 20 and each of the window sashes 25 and 26. The weatherstrip 30 is custom fit in any of a variety of pile sizes, as indicated in FIGS. 5*a–e*. In FIGS. 1–4, the top weatherstrip 30A has a longer pile 35 and is used in top groove 25 to fill the wider space between the top sash 41 and the parting stop 20 and the bottom weatherstrip 30B has a slightly shorter pile to fill the narrower space between the parting stop 20 and the bottom window sash 42.

Because of the ease of installation and removal the weatherstrip is capable of being replaced with another weatherstrip having a different size of pile 35 sufficient to fill an air gap between the improved parting stop and each of the window sashes.

The improved parting stop 20 is preferably formed of a molded or extruded synthetic rigid material. The weatherstrip is preferably formed of a molded or an extruded synthetic material with resilient ridges. The pile is preferably nylon or other material forming an airtight barrier, such as foam or silicone.

It is understood that the preceding description is given merely by way of illustration and not in limitation of the invention and that various modifications may be made thereto without departing from the spirit of the invention as claimed.

What is claimed is:

1. A snap-in compression-fit custom weatherstrip system for, and in combination with, a double hung window, the weatherstrip system having an improved vertical parting stop dividing the running tracks of an upper window sash and a lower window sash of the double hung window, wherein the system comprises:

a double hung window having a pair of vertical running tracks and an upper window sash and a lower window sash each capable of vertical movement within one of the pair of vertical running tracks;

an improved parting stop adapted to be inserted vertically in the double hung window to replace a conventional parting stop between the running tracks of the window sashes, the improved parting stop having a top vertical groove on one side of the improved parting stop from a top end of the improved parting stop along a portion of the improved parting stop equal to the height of the top sash and a bottom vertical groove on the other side of the improved parting stop from the bottom of the improved parting stop equal to the height of the bottom sash;

an elongated weatherstrip having a base with at least one resilient ridge on each of two sides of the weatherstrip running the length of the weatherstrip, the base capable of being inserted in the vertical grooves of the parting stop with a compression fit, the resilient ridges capable of compressing upon insertion in the grooves and capable of retaining the weatherstrip in the grooves with an airtight friction fit, and an air barrier material running the length of the weatherstrip along a top of the base, the weatherstrip capable of being cut into a length equal to the top vertical groove and a length equal to the bottom vertical groove, the two lengths capable of being pressed into the grooves for installation of the weatherstrip and pulled out of the grooves for removal with the improved parting stop installed in the window frame, the airtight barrier capable of preventing air from passing between the improved parting stop and each of the window sashes, the weatherstrip capable of being replaced with another weatherstrip having a different size of airtight material sufficient to fill an air gap between the improved parting stop and each of the window sashes.

2. The system of claim 1 wherein the airtight material comprises a pile permanently attached to the base and extending outwardly therefrom.

3. The system of claim 2 wherein the base comprises an extruded strip of synthetic material, T-shaped in cross-section, having at least one resilient ridge protruding from each side along the length of the strip.

4. The system of claim 3 wherein the pile is permanently attached to a flat top of the T-shaped cross-sectioned base.

5. The system of claim 4 wherein the grooves are T-shaped in cross-section to accommodate the weatherstrip pressed therein with only the pile protruding.

6. The system of claim 2 wherein the airtight material is a nylon pile.

7. The system of claim 2 wherein the airtight material further comprises a resilient air-impermeable strip adjacent to the pile running the length of the weatherstrip, the pile and the resilient strip capable of being compressed to fit between the improved parting stop and the sashes.

8. The system of claim 1 wherein the sashes shield the weatherstrip from view so that the weatherstrip is not visible with the sashes in the closed position.

9. The system of claim 1 wherein the improved parting stop is an extruded synthetic material.

10. The system of claim 1 wherein the improved parting stop is a molded synthetic material.

11. The system of claim 1 wherein the base of the weatherstrip is an extruded synthetic material.

12. A snap-in compression-fit custom weatherstrip system adapted to fit into a conventional double hung window having an upper window sash in a running track and a lower window sash in a running track, the running tracks separated by a conventional parting stop, the weatherstrip system having an improved vertical parting stop adapted to replace the conventional parting stop separating the running tracks of the upper window sash and the lower window sash of the double conventional hung window, wherein the system comprises:

an improved parting stop adapted to be inserted vertically in the conventional double hung window to replace the conventional parting stop between the running tracks of the window sashes, the improved parting stop having a top vertical groove on a first side of the improved parting stop from a top end of the improved parting stop along a portion of the improved parting stop equal only to the height of the top sash with no groove along the remaining portion of the first side and a bottom vertical groove on a second side of the improved parting stop from the bottom of the improved parting stop equal only to the height of the bottom sash with no groove along the remainder of the second side;

an elongated weatherstrip having a base with at least one resilient ridge on each of two sides of the weatherstrip running the length of the weatherstrip, the base capable of being inserted in the vertical grooves of the improved parting stop with a compression fit by pressing the weatherstrip into the improved parting stop, the resilient ridges capable of compressing upon insertion in the grooves and capable of retaining the weatherstrip in the grooves with an airtight friction fit, and an air barrier material running the length of the weatherstrip along a top of the base, the weatherstrip capable of being cut into a length equal to the top vertical groove and a length equal to the bottom vertical groove, the two lengths capable of being pressed into the grooves for installation of the weatherstrip and pulled out of the grooves for removal with the improved parting stop installed in the window frame, the airtight barrier capable of preventing air from passing between the improved parting stop and each of the window sashes with the window sashes in a closed position, the weatherstrip capable of being replaced with another weatherstrip having a different size of airtight material sufficient to fill an air gap between the improved parting stop and each of the window sashes, the weatherstrip system being adapted so that the sashes shield the weatherstrip from view so that the weatherstrip is not visible with the sashes in the closed position, and the weatherstrip system further adapted so that there is no weatherstrip contacting either of the window sashes in an open position so that sashes open and close with less friction than having a weatherstrip run the entire length of the parting stop on both sides.

13. The system of claim 12 wherein the airtight material comprises a pile permanently attached to the base and extending outwardly therefrom.

14. The system of claim 13 wherein the base comprises an extruded strip of synthetic material, T-shaped in cross-section, having at least one resilient ridge protruding from each side along the length of the strip.

15. The system of claim 14 wherein the pile is permanently attached to a flat top of the T-shaped cross-sectioned base.

16. The system of claim 15 wherein the grooves are T-shaped in cross-section to accommodate the weatherstrip pressed therein with only the pile protruding.

17. The system of claim 13 wherein the airtight material is a nylon pile.

18. The system of claim 13 wherein the airtight material further comprises a resilient air-impermeable strip adjacent to the pile running the length of the weatherstrip, the pile and the resilient strip capable of being compressed to fit between the improved parting stop and the sashes.

19. The system of claim 12 wherein the improved parting stop is an extruded synthetic material.

20. The system of claim 1 wherein the improved parting stop is a molded synthetic material.

* * * * *